United States Patent [19]

Clifton

[11] 4,389,736

[45] Jun. 28, 1983

[54] TOOL BELT SUSPENDERS

[76] Inventor: Norman L. Clifton, 4806 Los Arboles Pl., Fremont, Calif. 94536

[21] Appl. No.: 261,575

[22] Filed: May 7, 1981

[51] Int. Cl.[3] ..... A41F 3/04; A41F 3/02; A44B 21/00

[52] U.S. Cl. ..... 2/328; 2/340; 24/248 E

[58] Field of Search ..... 2/300, 301, 312, 321, 2/326, 327, 328, 340; 24/248 E, 248 B, 265 EC, 265 R

[56] References Cited

U.S. PATENT DOCUMENTS 877,332 1/1908 Hayden ..... 2/325

3,313,511 4/1967 Koerner ..... 24/265 R X

FOREIGN PATENT DOCUMENTS 306567 3/1933 Italy ..... 2/328

689899 4/1965 Italy ..... 2/340

*Primary Examiner*—Richard J. Scanlan, Jr.

*Attorney, Agent, or Firm*—Alvin E. Hendricson

[57] ABSTRACT

Suspenders formed of a strong non-stretch material have an adjustably positioned strap crossover with an aperture therein and high strength clasps removably attached to and adjustably positioned upon at least rear strap ends for comfortably hanging a tool belt or the like from the shoulders of a wearer of substantially any size.

2 Claims, 4 Drawing Figures

TOOL BELT SUSPENDERS

BACKGROUND OF INVENTION

Conventional suspenders that are worn to hold up pants and often made of a stretch material have a pair of straps that are joined together in the back as by an angled cross over and include length adjustments and clamping or hooking means for attachment to the waistband of trousers. It is also known to form suspenders or shoulder straps from non-stretch material for supporting a belt adapter to carry tools, supplies and the like. Various different suspenders are shown, for example, in U.S. Pat. Nos. 861,936, 2,587,126, 3,052,891, 3,089,143, German Pat. No. 612,702 and Italian Pat. No. 630,353.

Conventionally, suspenders incorporate only limited length adjustments and must then be provided in a number of different sizes to fit persons of different height and girth. Also, so-called tool belt suspenders are subject to substantial stress on the clamps employed to attach a tool belt so that failure thereof often results.

The present invention provides an improved suspender for tool belts and the like which overcomes many of the prior art problems therein.

SUMMARY OF INVENTION

There is provided by the present invention suspenders formed of a high strength non-stretch material with an adjustably positioned rear cross-over piece having an opening therethrough for hanging of the suspenders upon a peg or the like to display same for sale. High strength clamps are removably attached to the ends of the suspender straps by a Velcro attachment for example, so that a user may readily replace the clamps without sewing operations.

BRIEF DESCRIPTION OF FIGURES

The present invention is illustrated in the accompanying drawings, wherein.

DESCRIPTION OF PREFERRED EMBODIMENT

Figures 1, 2, 3, 4:
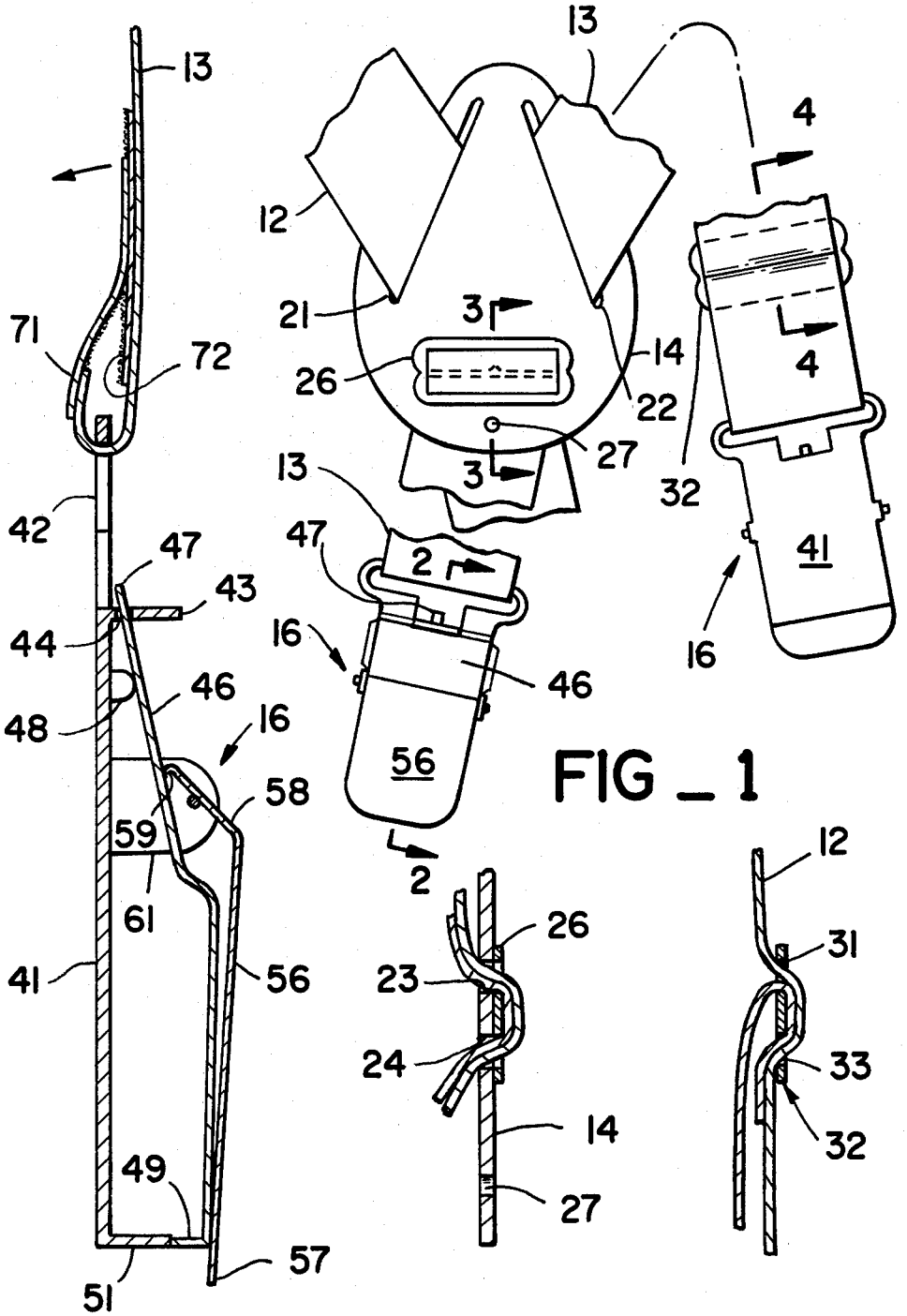
FIG. 1 is a partial rear elevational view of a pair of suspenders in accordance with the present invention.
FIG. 2 is an enlarged sectional view of a clasp of FIG. 1 and taken in the plane 2—2 of FIG. 1.
FIG. 3 is a sectional view of a portion of the cross over piece and straps taken in the plane 3—3 of FIG. 1.
FIG. 4 is a sectional view of strap adjustment means taken in the plane 4—4 of FIG. 1.

The present invention as illustrated in the accompanying drawings basically comprises a pair of straps 12 and 13 adapted to extend over the shoulders of a wearer and crossing in the back at a crossover piece or element 14 further described below. At both ends of each of the straps 12 and 13 there are provided clasps 16 for removable engagement with a belt or the like from which there may be hung tools, pouches for supplies or any of a variety of heavy goods to be carried by the wearer of the suspenders. In the present description the belt to be supported by the suspenders hereof is termed a tool belt; however, it will be appreciated that any of a wide variety of goods may be carried by the belt. The straps 12 and 13 are formed of an inextensible material of high strength such as, for example, nylon webbing having a substantial width as of the order of 2 inches or the like in order to readily support the weight of a tool belt and items carried thereby.

In order to prevent the straps 12 and 13 from slipping from the shoulders of a wearer the straps are crossed in the back, as briefly noted above and referring particularly to FIG. 1 and FIG. 3 there will be seen to be illustrated a crossover piece 14 which may, for example, be formed of a fairly thick leather. This crossover piece 14 is shown to have a generally triangular configuration with rounded corners with upper slots 21 and 22 inclined toward each other at the top of the piece 14 generally parallel to the inclined sides of the piece. Adjacent the bottom of the crossover piece 14 there are also provided a pair of parallel slots 23 and 24. Each of the slots 21 through 24 have a length slightly greater than the width of the straps 12 and 13 and the slot widths are made sufficient for the straps to readily extend through the slots and in the case of the lower horizontal slots 23 and 24 the slot widths are slightly greater inasmuch as both straps extend therethrough. Considering now the manner in which these straps engage the crossover piece 14 it is noted that each of the straps 12 and 13 extend diagonally downward over the top edges of the piece 14 and through the slots 21 and 22 respectively. Both straps 12 and 13 then extend outwardly from the back of the piece 14 through the slot 23 and back down through the slot 24 to the back of the piece wherefrom they extend on downwardly to the clasps 16 at the end of the straps. There is also provided an apertured plate 26 which fits over the crosspiece 14 at the slots 23 and 24 and is provided with mating slots so that the straps actually are surrounded in extension through the slots 23 and 24 by the metal plate 26. This plate 26 is provided for strengthening and prolonging the wear qualities of the crosspiece 14 and includes a pointed projection in one of the slots thereof for gripping the straps to prevent slipping. In common with other suspenders, the strips 12 and 13 change angles in passage through the crosspiece 14, as generally illustrated in FIG. 1 of the drawings. The crosspiece 14 is also provided with an aperture 27 through the crosspiece at an end thereof to provide for hanging of the suspenders upon a peg, nail or the like during storage and/or display for sale. This manner of hanging up the suspenders of the present invention has been found to be highly advantageous in that a plurality of suspenders may be readily mounted upon a single peg or the like so as to be readily accessible for removal and use and also at the same time to be readily visible, substantially in their entirety while yet occupying a small amount of space.

The suspenders of the present invention incorporate means for adjusting the length thereof and in this respect reference is made to FIG. 4 illustrating, for example, the strap 12 which extends upwardly through a first slot 31 in a metal plate 32 and then back down through a second slot 33 therein. The strap 12 extends from the plate 32 in a loop for engagement with a clasp, described below, and thence back to the plate 32 with the end of the strap extending upwardly through the first slot 31 and back down to the second slot 33, as illustrated. In this conventional manner it is possible to pull the end of the strap 12 to shorten the loop thereof below the plate 32 and thus to shorten the suspenders.

The suspenders of the present invention also incorporate particular clasps for engaging a tool belt or the like and these clasps are particularly designed to accommodate the weight of such a tool belt and appertenances. Referring now to FIG. 2 of the drawings, there will be seen to be illustrated in enlarged form a central sectional view of a clasp in accordance herewith and including a bottom plate 41 having a laterally extended flat ring 42 at the rear thereof through which an end of a strap is intended to extend. The manner of engaging the clasp with the strap is further described below. The plate 41 has an upturned tab 43 at the rear thereof forwardly of the hoop 42 and this tab has a small slot 44 therethrough, as illustrated. There is also provided a resiliently flexible upper plate 46 having a rear tab 47 extending through the aperture 44 in the lower plate extension 43. The upper plate 46 extends forwardly over one or more upward projections 48 on the lower plate 41 and thence forwardly to a depending front portion 49 adapted to engage an upturned front portion 51 of the lower plate 41. The engagement of upper and lower plates at the front thereof may incorporate a sawtooth arrangement if desired to positively grip a tool belt or the like between the projections 49 and 51. It is also noted that the upper plate 46 is resiliently deflected in extension over the projections 48 in order for the front of the upper plate to engage the front of the lower plate in the position illustrated in FIG. 2.

An over center lock is provided for holding the front edges of the upper and lower plates of the clasp together and in FIG. 2 this will be seen to be comprised as a pivot plate 56 overlying the upper plate 46 and extending forwardly therefrom as a tab 57 that is readily accessible to engagement by the fingers of the user in order to undo the clasp. The upper plate 56 adjacent the rear thereof has a downturned portion 58 terminating in a short forwardly extending edge 59 adapted to ride upon the upper surface of the plate 46. The pivot plate 56 has short lateral extensions on the inclined portion 58 thereof which fit into upstanding lugs 61 on the sides of the lower plate 41 so as to be pivotally mounted between these lugs.

In the position illustrated in FIG. 2, the pivot plate 56 of the clasp 16 will be seen to apply a force downwardly to the forward end of the upper plate 46 in order to clamp the upper plate against the lower plate at the leading edge thereof. In order to open the clasp, it is only necessary to engage the front tab 57 of the pivot plate as by a finger and press upwardly in order to pivot the pivot plate so as to move the downturned edge 59 forwardly along the upper plate 46 by deflecting the latter until this edge 59 is sufficiently forward that the pivot plate 56 may be swung vertically to entirely release the pressure applied to the upper plate 46. It is to be appreciated that the elements of the clasp, as illustrated and described above, are formed of metal having a substantial strength so as to accommodated repeated use and also to apply sufficient pressure at the front portions 49 and 51 of the plates to very firmly grip a belt or the like which may be disposed between these portions. The present invention also provides for removable attachment of the clasps 16 and in this respect attention is again directed to FIG. 2. While it is possible to removably attach the clasps to the straps in a variety of ways there is illustrated in the drawings one preferred manner wherein a very firm and supportive attachment is achieve and yet ready detachment is available. Mating pieces of material 71 and 72 are provided with facing surfaces which, upon contact, firmly grip each other to prevent lateral movement of one with respect to the other and yet which may be pulled apart by lifting one from the other. Material of this type is sold under the trademark Velcro. One of the pieces 71 is attached as by sewing to the end of the strap 13 and the other piece of material 72 is attached as by sewing to the back side of the strap 13 at a distance from the end thereof, all as illustrated in FIG. 2. The end of the strap 13 with the material 71 attached thereto is then threaded through the flattened ring 42 at the end of the clasp 16 and turned back, as illustrated, into contact with the exposed surface of the material 72 on the strap 13. This manner of attachment of the clasp provides for a substantially permanent engagement of strap and clasp except under those circumstances where it may be desired to replace the clasp or to slightly move the location thereof with respect to the end of the strap. Under these circumstances it is only necessary for a user to lift a corner of the material 71 and peel it from the attached material 72. The strap then may then be unthreaded from the clasp ring for replacement of the clasp or the like.

The suspenders of the present invention are particularly adapted to engagement with a tool belt or the like which may carry heavy items such as tools, supplies, or other materials. The strong inextensible nature of the straps 12 and 13 hereof provide a good support for carrying heavy weights and the clasps of the present invention are particularly adapted to firmly engage a tool belt or the like and to support same despite the weight that may be carried by the belt. The length of the straps may be adjusted as described above and the location of the cross piece 14 of the suspenders hereof may be adjusted by sliding the straps therethrough. It is also noted that the aperture 27 in the cross piece 14 is particularly adapted to facilitate hanging of the suspenders hereof upon a peg nail or the like for storage and display. There is thus provided by the present invention an improved tool belt suspenders of simple and yet highly advantageous structure.

Although the present invention has been described above with respect to a single, preferred embodiment thereof it will be appreciated by those skilled in the art that numerous modifications and variations may be made within the spirit and scope of the present invention and thus it is not intended to limit the invention to the precise details of illustration or terms of description.

What is claimed is:

1. Improved suspenders for supporting a belt adapted to carry tools or the like comprising a pair of straps adapted to extend one over each shoulder of a wearer and to cross in the back, a cross-over piece having a pair of inclined slots disposed above a pair of horizontal slots through which said straps are threaded to cross over each other, said straps being separately threaded through said inclined slots and both straps being threaded through both horizontal slots, and said piece having an aperture therethrough for hanging of the suspenders on a peg or the like, and strong metal clasps attached to each end of each of said straps and each having an over center lock thereon for firmly gripping a belt between facing ends of a pair of plates.

2. The suspenders of claim 1 further defined by said clasps each having a rigid lower plate with an integral ring portion defining a rear aperture and an upturned front end with at least one upward projection spaced from a rear end, a resiliently flexible upper plate with a downturned front end and engaging said lower plate adjacent the rear thereof and extending over said projection, and a pivot plate pivotally mounted at a distance from a rear end thereof on said lower plate above said upper plate and having a depending rear portion bearing on said upper plate whereby pivoting of said pivot plate moves same between a clamping position resiliently forcing front facing ends of said upper and lower plates together and a release position out of forceable relation to said upper plate whereby said upper and lower plates are separable at the front ends thereof.

* * * * *